US009346568B2

(12) United States Patent
Korte et al.

(10) Patent No.: US 9,346,568 B2
(45) Date of Patent: May 24, 2016

(54) ROTATABLE PACKING MACHINE AND METHOD FOR FILLING OPEN BAGS

(75) Inventors: Michael Korte, Oelde (DE); Frank Waltermann, Ahlen (DE); Christian Westarp, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 156 days.

(21) Appl. No.: 14/116,521

(22) PCT Filed: May 2, 2012

(86) PCT No.: PCT/EP2012/001873
§ 371 (c)(1),
(2), (4) Date: Dec. 11, 2013

(87) PCT Pub. No.: WO2013/013731
PCT Pub. Date: Jan. 31, 2013

(65) Prior Publication Data

US 2014/0083559 A1 Mar. 27, 2014

(30) Foreign Application Priority Data

May 9, 2011 (DE) ..... 10 2011 101 040

(51) Int. Cl.

| | |
|---|---|
| ***B65B 1/10*** | (2006.01) |
| ***B65B 3/04*** | (2006.01) |
| ***B65B 43/46*** | (2006.01) |
| ***B65B 43/60*** | (2006.01) |
| *B65B 1/22* | (2006.01) |

(52) U.S. Cl.
CPC ..... *B65B 3/04* (2013.01); *B65B 43/465* (2013.01); *B65B 43/60* (2013.01); *B65B 1/10* (2013.01); *B65B 1/22* (2013.01)

(58) Field of Classification Search
CPC ..... B65B 1/04; B65B 1/06; B65B 1/20; B65B 43/46; B65B 43/465; B65B 43/58; B65B 43/59; B65B 43/60
USPC ..... 141/10, 114, 313–317
See application file for complete search history.

(56) References Cited

U.S. PATENT DOCUMENTS

| | | | | |
|---|---|---|---|---|
| 2,833,097 | A * | 5/1958 | Petrea et al. | 53/571 |
| 3,748,823 | A * | 7/1973 | Mayer | 53/570 |
| 3,961,461 | A | 6/1976 | Ruf et al. | |
| 4,019,546 | A * | 4/1977 | Hastrup | 141/10 |

(Continued)

FOREIGN PATENT DOCUMENTS

| | | |
|---|---|---|
| DE | 1035555 | 7/1958 |
| DE | 3416155 | 1/1985 |

(Continued)

*Primary Examiner* — Nicolas A Arnett
(74) *Attorney, Agent, or Firm* — Pearne & Gordon LLP

(57) ABSTRACT

Rotary packaging machine and method for filling open-mouth bags with multiple filling units disposed over the circumference and rotating along, each of which having a filling spout with a bottom filling opening, wherein the open-mouth bags can be appended by way of a motion oriented upwardly relative to the filling spout. A transfer device for transferring the open-mouth bags intended for filling to the filling units is provided. The transfer device comprises a gripping arm including a gripping unit provided thereat. The gripping arm is rotatingly disposed at the transfer device. A longitudinal speed of the longitudinal motion of the gripping arm is temporarily adapted to a peripheral speed of the circumferential motion of the filling spouts.

15 Claims, 6 Drawing Sheets

(56) References Cited

U.S. PATENT DOCUMENTS

Figure 1:
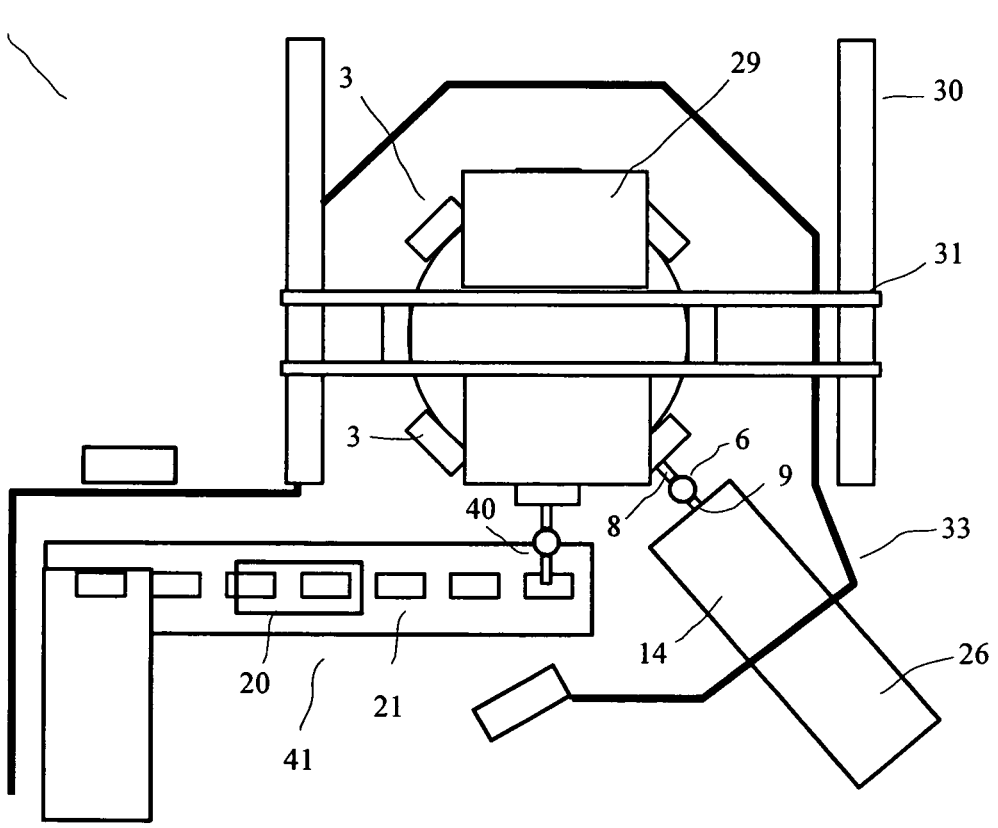

| | | | | |
|---|---|---|---|---|
| 4,045,940 | A * | 9/1977 | White et al. | 53/447 |
| 5,457,930 | A * | 10/1995 | Dauder-Guardiola | 53/138.3 |
| 7,162,852 | B2 | 1/2007 | Eder | |
| 7,856,792 | B2 * | 12/2010 | Koga et al. | 53/53 |
| 7,954,307 | B2 * | 6/2011 | Paunesku et al. | 53/459 |
| 8,245,485 | B2 * | 8/2012 | Fukeda et al. | 53/95 |
| 8,943,783 | B2 * | 2/2015 | Ouellet et al. | 53/469 |
| 2005/0229550 | A1 | 10/2005 | Eder | |
| 2007/0074492 | A1 * | 4/2007 | Koga et al. | 53/512 |
| 2007/0089377 | A1 * | 4/2007 | Yasuhira | 53/403 |
| 2007/0204570 | A1 * | 9/2007 | Okazaki | 53/459 |
| 2008/0072547 | A1 | 3/2008 | Murray | |
| 2009/0233778 | A1 * | 9/2009 | Tsutsui et al. | 493/212 |
| 2010/0018160 | A1 * | 1/2010 | Fukeda et al. | 53/407 |
| 2012/0240531 | A1 * | 9/2012 | Kawamura et al. | 53/572 |
| 2013/0125508 | A1 * | 5/2013 | Honda | 53/268 |
| 2013/0160400 | A1 * | 6/2013 | Decio | 53/284.7 |
| 2013/0192720 | A1 * | 8/2013 | Ouellet et al. | 144/24.17 |
| 2014/0083560 | A1 * | 3/2014 | Vollenkemper et al. | 141/10 |
| 2014/0250834 | A1 * | 9/2014 | Yoshikane et al. | 53/403 |
| 2014/0283483 | A1 * | 9/2014 | Yoshikane et al. | 53/403 |
| 2014/0325938 | A1 * | 11/2014 | Yoshikane et al. | 53/79 |
| 2014/0331603 | A1 * | 11/2014 | Takahashi | 53/408 |
| 2014/0352253 | A1 * | 12/2014 | Yamamoto et al. | 53/76 |

FOREIGN PATENT DOCUMENTS

| | | |
|---|---|---|
| DE | 3539470 | 7/1986 |
| DE | 4439655 | 5/1995 |
| DE | 20309914 | 9/2003 |
| DE | 10235929 | 3/2004 |
| WO | 2004014729 | 2/2004 |

* cited by examiner

ROTATABLE PACKING MACHINE AND METHOD FOR FILLING OPEN BAGS

The present invention relates to a rotary packaging machine and a method for filling open-mouth bags. The packaging machine according to the invention may be intended for bagging all kinds of bulk goods. This kind of system is particularly preferably used for bagging fine-grain products, i.e. for bagging fine and dusty products requiring extended filling and in particular compacting times.

A great variety of packaging machines for filling open-mouth bags have been disclosed in the prior art. For example so-called FFS packaging machines ("Form-Fill-Seal packaging machines") tend to be used for efficiently filling bulk materials into open-mouth bags. In these FFS packaging systems the open-mouth bag is manufactured within the machine or in an immediately preceding device. The machine has a roll of tubular sheet assigned to it from which the required open-mouth bags are continuously manufactured during operation. A considerable advantage of these FFS packaging machines consists in that the open-mouth bags can be manufactured in the actually required lengths. There is no need to employ preformed bags which are also more expensive.

FFS packaging machines process open-mouth bags of plastic sheets which may be waterproof. This is why open-mouth bags filled with hygroscopic materials—such as cement—are suitable for open-air storage after closing since their contents are reliably protected against moisture. The drawback of known packaging machines for filling open-mouth bags is their limited capacity in particular when bagging dusty, fine-grain products since these products must as a rule be compacted to provide a firm package in which the smallest possible amount of air is contained. Entrapped air moreover reduces the stacking capability.

For increasing throughput, packaging machines for filling open-mouth bags have been disclosed which are rotary in construction and comprise multiple filling spouts distributed over the circumference to which open-mouth bags are appended for filling. To ensure reliable appending of the bags to the filling spouts, a known packaging machine for filling open-mouth bags having four filling spouts is rotated indexed by 90 degrees and then stopped. When the system stops, the open-mouth bag is appended to the filling spout from beneath while the filling process is already started for the next filling spout in sequence. The indexed operation of such a rotary packaging machine attains an extended compacting period. While an open-mouth bag is being appended to the first filling spout, the filling process may take place at a second and a third filling spout while vibrating devices act simultaneously on the open-mouth bags intended for filling to lower the product level and attain compacting.

Vibrating devices are routinely used in filling fine-grain products into open-mouth bags to lower the product level as far as possible. In this way the bag length required for a specific quantity of product can be reduced which may considerably reduce the costs for the open-mouth bags used since a reduced quantity of tubular sheet is required for manufacturing an open-mouth bag. In the case of continuously operating such a packaging machine for filling open-mouth bags, savings of expenses may be considerable if the bag length can be lessened by as little as one centimeter.

Another argument in favor of employing vibrating devices is that the open-mouth bags filled with the product are tightly filled after closing and are thus much more attractive in appearance than bags still containing a high volume of air and showing large overhangs of sheet at their ends.

A significant criterion for attaining high throughput when filling bulk goods into open-mouth bags is, automated placement of the open-mouth bags intended for filling onto the filling spout. In the case of stationary systems the prior art solves automated placement of the open-mouth bags intended for filling onto the filling spout of the system in that a pre-opened, open-mouth bag is placed onto the stationary filling spout from beneath by way of a pivoting motion of a floating gripper. Such placement reliably functions in stationary systems. Basically this is also possible in indexed rotary systems since the filling spouts are stationary during placement. However, if a packaging machine is operated rotating continuously then the brief point in time of rotating past is not sufficient for these bag placers to append the pre-opened bag onto the filling spout.

Packaging machines for filling open-mouth bags configured to rotate have also been disclosed in the prior art. The open-mouth bags intended for filling are handed over to the rotary packaging machine by means of floating grippers which transfer the empty bag hanging down flat, to grippers of the packaging machine that rotate along. Each filling unit of the packaging machine is provided with a bag opener that opens the upper bag walls that lie on top of one another and makes an opening into the upper bag wall adapted to the filling spout. Although this packaging machine is basically functional its construction is very complex. Due to the fact that a separate bag opener must be provided for each filling spout and since all the filling units are moreover configured to rotate continuously, this type of packaging machine cannot be economically manufactured and employed.

For filling bulk goods into valve bags, packaging machines have been disclosed which packaging machines are constructed rotary and where the valve bags intended for filling are shot onto the filling spouts while the packaging machine is rotating. However, the filling mouths of valve bags are considerably smaller than those of open-mouth bags and they tend to comprise at least one paper layer that causes the valve bag and in particular the valve to be rather stiff. Moreover, the filling spouts in rotary valve bag packaging machines extend approximately horizontally radially outwardly and the valves of the valve bags are shot from radially outwardly onto the horizontally aligned filling spouts. During placing or shooting on the valve bags bridge a radial distance between the bag placer and the filling spout in free flight. This is to avoid collision of the stationary bag placer with the rotating portion of the system. This method works reliably since valve bags show a comparatively high inherent stiffness and since the cross section of the bag valve is small so that they show sufficient stability for the distance to be overcome in free flight.

Open-mouth bags, however—as the name indicates—are constructed open on top and the filling spouts used are considerably larger in cross-section. Moreover, open-mouth bags tend to consist of very flexible sheet materials so as to require defined support for the bag opening required for placing during the placing process so as to ensure defined handover of the open-mouth bag intended for filling and a precisely defined seat of the open-mouth bag at the filling spout. Therefore it is not possible to bridge even a comparatively small distance in free flight when placing an open-mouth bag onto a filling spout.

Moreover, when filling fine-grained bulk goods into open-mouth bags, a vibrating plate is as a rule used on which the bottom of the open-mouth bag is sitting during the filling process. In this way a linear placement onto a filling spout of an open-mouth bag packaging machine is not readily possible since the vibrating plate is positioned exactly beneath the filling spout. In the case of valve bag packaging machines, however, radial motion for shooting on is unhindered.

It is therefore the object of the present invention to provide a packaging machine for filling open-mouth bags which—even when bagging fine-grain bulk goods—allows high throughput.

This object is solved by a packaging machine having the features of claim 1 and by a method having the features of claim 13. Preferred specific embodiments are the subjects of the respective subclaims. Further advantages and features of the present invention can be taken from the general description and the description of the exemplary embodiment.

The rotary packaging machine according to the invention for filling open-mouth bags comprises multiple filling units disposed over the circumference and rotating along, each of which having a filling spout with at least one filling opening at the bottom. The open-mouth bags can be appended to the filling spouts by way of a motion oriented upwardly relative to the filling spout. A handling unit configured as a transfer device is provided for transferring the open-mouth bags intended for filling to the filling units. The transfer device comprises at least one gripping arm including a gripping unit provided thereat. The gripping arm is rotatably disposed at the transfer device. A longitudinal speed of the longitudinal motion of the gripping arm is adapted to a peripheral speed of the circumferential motion of the filling spouts at least temporarily.

In particular is the longitudinal speed of the longitudinal motion of the gripping arm periodically, for a time period, approximately adapted to a peripheral speed of the filling spouts.

The rotary packaging machine according to the invention has many advantages. A considerable advantage of the rotary packaging machine according to the invention consists in that not only the packaging machine is constructed rotary but the transfer device is likewise constructed circumferential or rotary. This allows to append the open-mouth bags intended for filling during a continuous rotary motion. By way of synchronized motions of the packaging machine and the transfer device a defined transfer and defined appending of the open-mouth bags intended for filling are enabled. Adaptation of the longitudinal speed of the gripping arm to the peripheral speed of the filling spouts allows a considerably extended transfer time.

Preferably the gripping arm is disposed at the transfer device to be longitudinally movable for carrying out a longitudinal motion relative to the transfer device. A gripping arm disposed longitudinally movably at the transfer device allows an advantageous way of considerably increasing the synchronous motion between the filling spout and the open-mouth bag intended for appending. The longitudinal motion then preferably takes place at least approximately in the peripheral direction of the rotary packaging machine. Preferably the longitudinal motion is approximately tangential or on a slightly curved path along the periphery. The longitudinal motion is preferably carried out in synchrony with the motion of a filling spout so that for transferring the open-mouth bag intended for filling to a filling spout, the gripping unit with the open-mouth bag intended for filling is firstly located beneath the filling spout. Finally the open-mouth bag is placed onto the filling spout during the circumferential motion or rotary motion.

It is possible for the longitudinal motion of the gripping arm to form a tangent, passant or secant line to the rotary motion of the filling spouts relative to the transfer device. Or else it is possible for the longitudinal motion to include, other than a peripheral element, a vertical element so that simultaneous longitudinal and vertical motions take place with which the opened bag is pushed from beneath onto a filling spout of a filling unit.

In all the configurations it is particularly preferred for the transfer device to be at least also linearly movable. Linear drive constructions can be readily realized and show high reliability. Optionally, longitudinal motion along a circle segment is likewise possible. A circumferential conveyor belt or a circumferential conveyor chain or the like are possible as well.

Preferably the longitudinal speed of the longitudinal motion of the gripping arm is adapted to a peripheral speed of the filling spouts at least temporarily.

In all the configurations it is preferred for the gripping arm to travel around the transfer device indexed. This means that by way of traveling around the transfer device the gripping arm approaches an open-mouth bag intended for filling to the filling spout with the placing operation occurring during the longitudinal motion of the gripping arm relative to the transfer device. This configuration offers considerable advantages since the region of the filling spout overlapping with the open-mouth bag intended for appending or with the top bag opening of the open-mouth bag intended for appending is considerably increased. The longitudinal motion which is substantially carried out in parallel to a tangent to the circumference of the packaging machine allows a comparatively long transfer time. An extended transfer time is often required for ensuring a defined gripping of the open-mouth bag intended for filling at all times.

It is possible for the entire or only part of the gripping arm to be configured to rotate along with the transfer device. It is also possible for the gripping arm to be disposed at a kind of rotating belt, chain or the like which rotates around the transfer device so that the gripping arm travels around the transfer device in a circular, elliptic, or other shape of orbit path.

For transferring the open-mouth bag intended for filling it is as a rule required for the gripping unit of the gripping arm to first hold the open-mouth bag intended for filling in a defined position. As the upper bag wall of the open-mouth bag intended for appending reaches the suitable transfer position, grippers provided at the filling unit grip the upper bag wall while simultaneously the gripping unit is still holding the upper bag wall of the open-mouth bag intended for appending. Only when the grippers of the filling unit have securely gripped the open-mouth bag intended for appending does the gripping unit of the gripping arm release its grippers.

This process ensures that holding the bag intended for filling is exactly defined at all times. This allows to decrease the bag overhangs and ensures an optically attractive appearance of the bag.

An indexed rotation of the transfer device or an indexed circling of the gripping arm is advantageous since the longitudinal motion of the gripping arm can ensure the required overlap between the filling spout and the top bag opening.

In all the configurations it is preferred that at least the gripping unit is height-adjustable. In particular is the height adjustment in the gripping unit used for pushing the open-mouth bag intended for appending from beneath onto a filling spout. Or else it is possible for the filling spout of the filling unit to be configured for lowering so that the filling spout is inserted into the upper bag wall of the open-mouth bag intended for appending. It is also possible for both the filling spout and the gripping unit to be adjusted in height for appending the bag. In all these configurations the bag is appended relative to the filling spout by way of upwardly motion.

The gripping arm is particularly preferably movable in height. By way of height adjustment of the gripping arm the height of the gripping unit disposed thereat is adjusted as well. A particularly advantageous configuration is for the gripping unit to be height-adjustable by pivoting the height of the gripping arm. This is for example realized by means of a vertically pivotal gripping arm.

For appending an open-mouth bag to a filling spout the gripping arm is first shifted to a base position in which the gripping arm remains until a filling spout reaches the suitable position during the rotary motion. Thereafter the gripping arm is accelerated in the direction of the longitudinal motion and moved beneath the filling spout in synchrony. As the suitable placing position is reached, the gripping arm pivots in height, thus pushing the open-mouth bag intended for appending over the filling spout with its top bag opening and thus appending it to the filling spout. After grippers of the filling unit grasp the open-mouth bag intended for appending, the gripping unit releases the upper bag wall of the bag intended for appending and the gripping unit together with the gripping arm pivot back downwardly in height.

By way of the continuing rotation of the packaging machine the appended open-mouth bag is removed from the gripping arm. Now the gripping arm rotates further for taking over the next open-mouth bag intended for appending.

The gripping arm may be provided with a bag opener which opens the upper bag wall of the open-mouth bag intended for appending while traveling around or while waiting for the next filling spout. It is possible and preferred for a bag opener to be positioned upstream of the transfer device so that an opened open-mouth bag is transferred to the transfer device. It is also possible for the bag opener to open the open-mouth bag intended for filling during transfer to the transfer device. At any rate a bag opener is not required for every filling spout. There is little complexity involved.

In all the configurations it is preferred for the filling unit to comprise at least one compactor. The compactor may be configured as a vibrating device.

Preferably a vibrating plate or the like is provided beneath the filling spout as the compactor onto which at least part of the bottom of the open-mouth bag intended for filling is sitting during the filling process. It is also possible and preferred to insert a compactor from above into the bag intended for filling, during or after the filling process, for compacting the bulk material e.g. by vibrating motions. This compactor is in particular configured as a poker vibrator or a vacuum lance or the like. In all the configurations it is preferred to provide a bag former positioned upstream of the packaging machine. Or else it is possible to use pre-fabricated open-mouth bags.

The method according to the invention serves for filling open-mouth bags by means of a rotary packaging machine comprising multiple filling units distributed over the circumference and rotating along. During rotation the open-mouth bags are appended to the bottom filling opening of the filling spouts by an upwardly motion relative to the filling spout. A transfer device is provided comprising at least one rotating gripping arm including at least one gripping unit and which by way of the gripping unit transfers the open-mouth bags to the filling unit during rotation. A longitudinal speed of the longitudinal motion of the gripping arm is at least temporarily adapted to a peripheral speed of the circumferential motion of the filling spouts.

The method according to the invention also has many advantages since it allows a reliable transfer of the open-mouth bags intended for filling to the filling units of a rotary packaging machine. The transfer of the open-mouth bags intended for filling to the filling unit may take place during the rotary motion.

Preferably the gripping unit is moved linearly or virtually linearly at least in portions to enable an extended handover phase. The motion of the gripping arm and/or at least one gripping unit may be arcuate, in particular if a radius of the arc is large relative to the length of the arc. Or else the gripping unit may be movable only approximately in an arc. Or else a longitudinal motion is possible that consists of multiple single motions.

The longitudinal motion of the gripping unit is in particular approximately tangential relative to the motion of the filling spouts. Particularly preferably the longitudinal motion of the gripping unit is not in an exact tangent line but approximately a secant line or substantially in parallel to a secant line so as to still further extend the handover phase. The distance between the tangent and secant lines is the maximum tolerance between the bag opening and the filling spout. Longitudinal motions extending in an approximately linear coil from a first point to a second point are also possible if they extend the handover phase.

In all the configurations it is preferred for the open-mouth bag to be appended to the filling spout from beneath by a pivoting motion of the gripping arm.

The invention allows high filling rates of open-mouth bags. By way of superimposing a longitudinal motion and in particular a linear motion with the rotary motion of the filling spouts on the circumference of the packaging machine the handover time can be extended so that a reliable and precisely defined handover of the open-mouth bags intended for filling to the filling spouts is allowed and ensured. The linear motion causes great extension of the time although the transfer device does not require much space. The gripping arm of the transfer device is linearly traversed in the peripheral direction for appending. The gripping arm is linearly traversed back before the next filling spout arrives in handover range. By way of rotation around the transfer device or by rotary motion of the transfer device a gripping arm on which the next open-mouth bag intended for appending has been placed is rotated to the handover position.

On the whole the invention provides a rotary packaging machine and a method for filling open-mouth bags allowing high filling rates of bags filled as defined. The quantity of bag sheets required is low so that filling the bags can be precisely defined.

Further advantages and features of the present invention can be taken from the exemplary embodiment which will be described below with reference to the enclosed figures.

Figure 2:
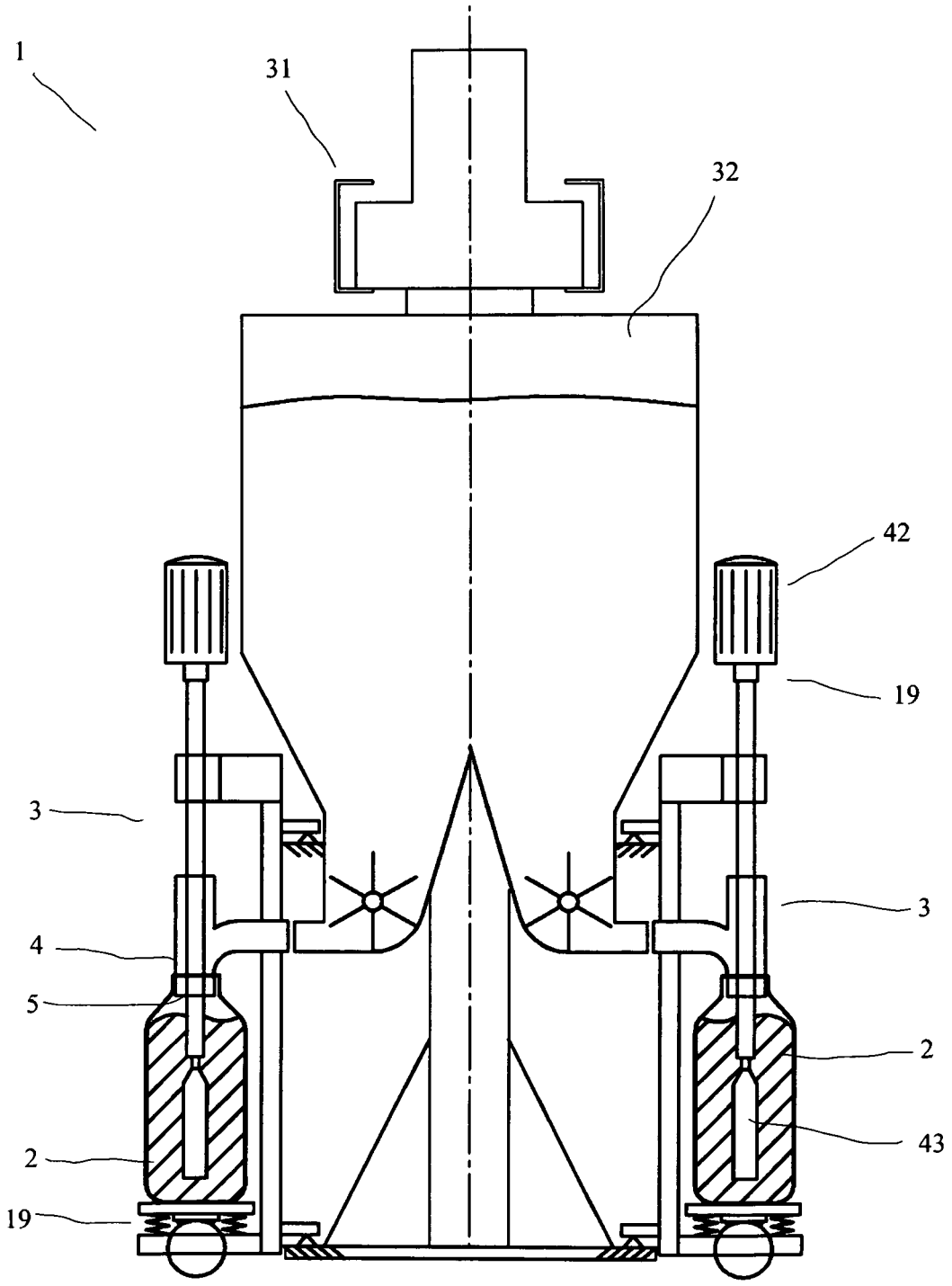
Figure 3:
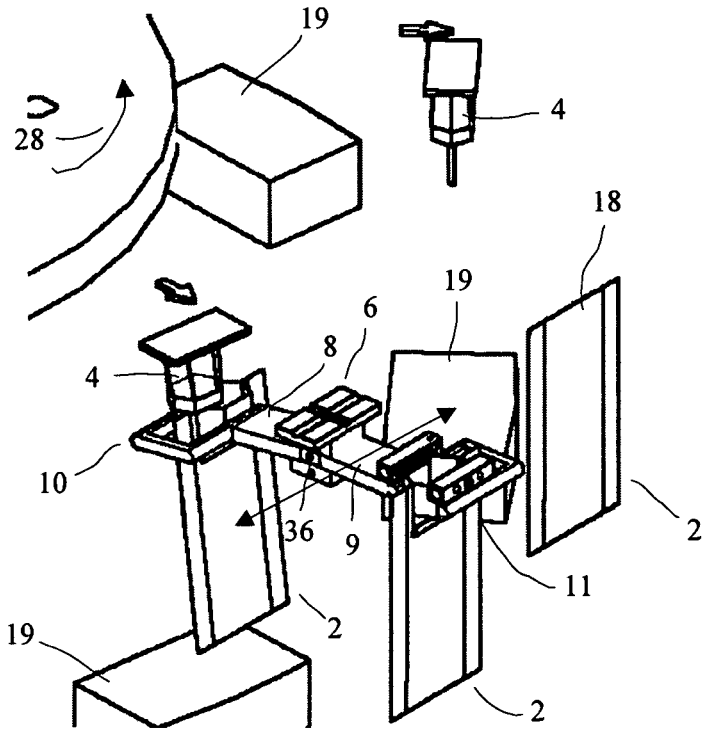
Figure 4:
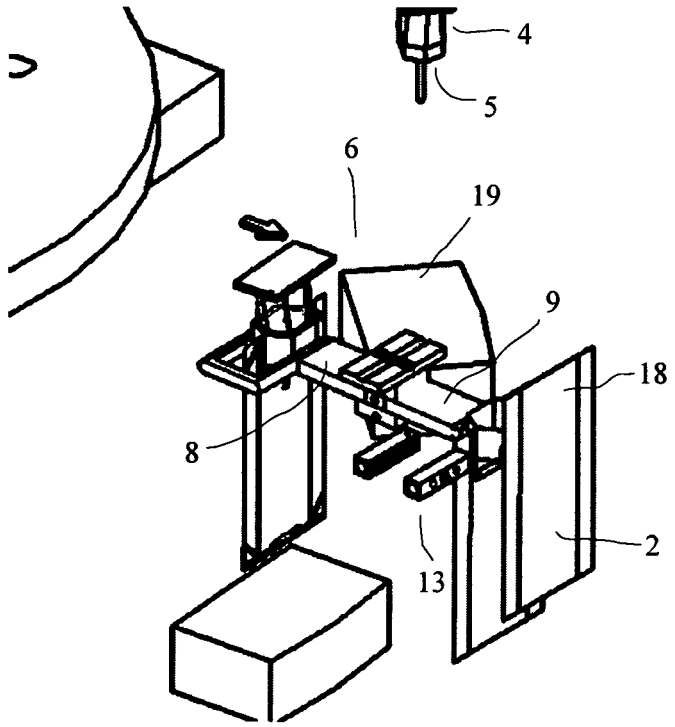
Figure 5:
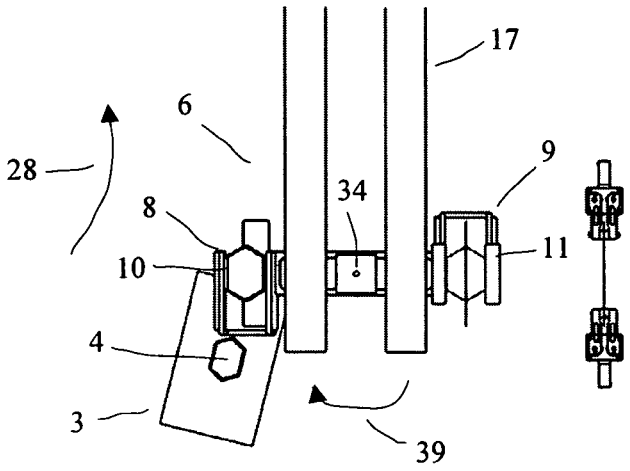
Figure 6:
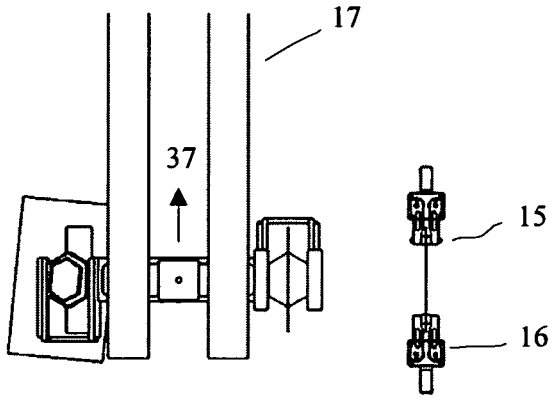
Figure 7:
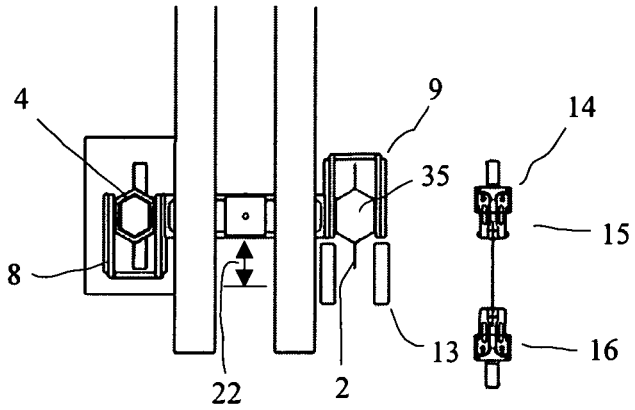
Figure 8:
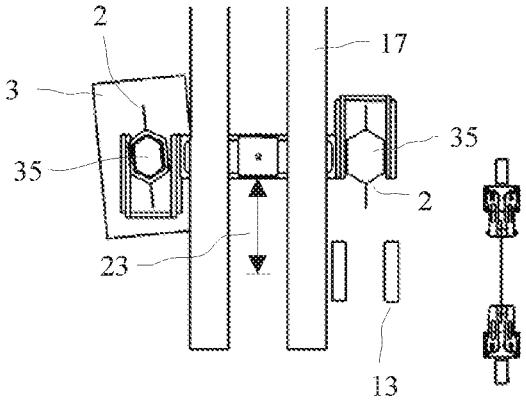
Figure 9:
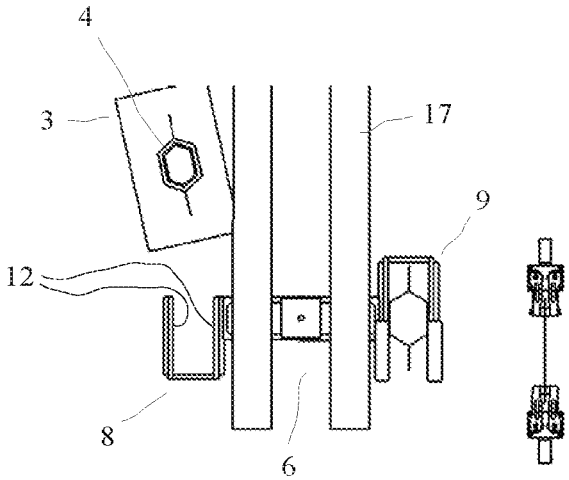
Figure 10:
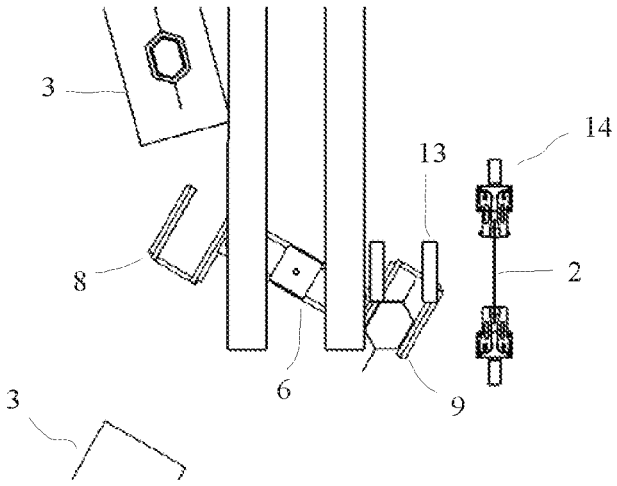
Figure 11:
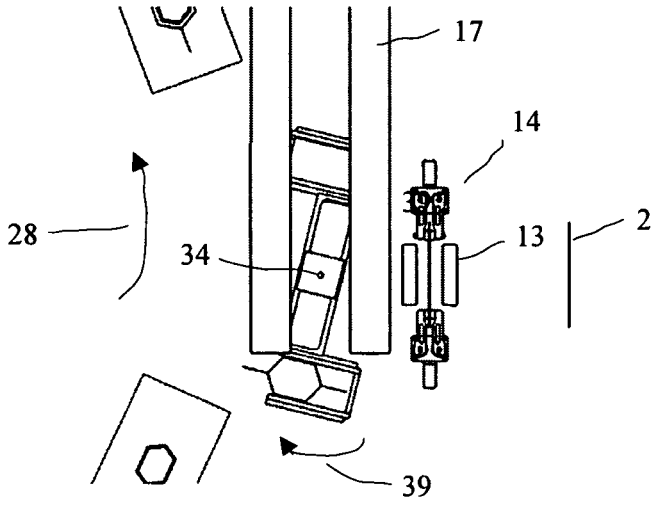
Figure 12:
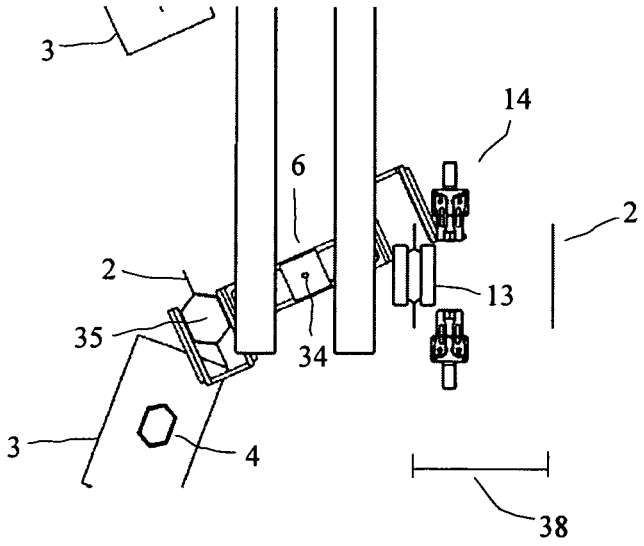

The drawings show in:

FIG. 1 a schematic top view of a packaging machine according to the invention;

FIG. 2 a side view of the packaging machine according to FIG. 1;

FIG. 3 a simplistic perspective view of the transfer device in a first position;

FIG. 4 the view according to FIG. 3 in the appending position;

FIG. 5 a simplistic top view of the transfer device in a first position;

FIG. 6 a view according to FIG. 5 in a second position;

FIG. 7 a simplistic top view according to FIG. 5 in a third position;

FIG. 8 a simplistic top view according to FIG. 5 in a fourth position;

FIG. 9 a simplistic top view according to FIG. 5 in a fifth position;

FIG. 10 a simplistic top view according to FIG. 5 in a sixth position;

FIG. 11 a simplistic top view according to FIG. 5 in a seventh position; and FIG. 12 a simplistic top view according to FIG. 5 in an eighth position.

With reference to the enclosed figures an exemplary embodiment of a rotary packaging machine 1 according to the invention will be discussed below, which is illustrated in FIG. 1 in a schematic top view. The rotary packaging machine 1 serves for filling open-mouth bags 2 (see FIG. 3) and is provided with multiple filling units 3 each of which is presently equipped with a filling spout 4. Between about two and sixteen filling units 3 can be disposed at the presently illustrated packaging machine 1. Basically it is also possible to install a still larger number of filling units at a rotary packaging machine 1.

The rotary packaging machine 1 is operated rotating continuously so that the filling units 3 rotate about a center axis at substantially constant speed. The speed depends in particular on the product intended for bagging and its compacting characteristics. The material intended for bagging is fed via an inlet hopper 29 and a silo 32 to the individual filling spouts 4 of the filling units 3.

The filling spouts 4 for filling the open-mouth bags 2 are presently aligned vertically so that the single filling opening 5 is directed perpendicularly downwardly. Or else it is possible for one or more filling openings to be aligned at an inclination to the vertical. For example an angle of five degrees, ten degrees, or else twenty degrees to the vertical may be provided. Open-mouth bags 2 are appended from beneath to the bottom filling opening 5 of the filling spouts 4.

To this end an open-mouth bag 2 is gripped and the upper bag wall 18 is opened so as to form the upper bag opening 35. Suckers and grippers are preferably used so as to form at the top end of the open-mouth bag 2 a bag opening 35 corresponding to the cross-sectional shape of the filling spout 4. The open-mouth bag 2 is held in a defined position by its top bag wall 18 by means of suckers and/or grippers until the open-mouth bag 2 has been pushed onto the filling spout 4 and is held there again in a defined position by presently not shown grippers.

The open-mouth bags 2 are placed by way of a transfer device 6 positioned downstream of a bag former 26. The bag former 26 manufactures the individual open-mouth bags 2 from a tubular sheet during the continuous operation. Desired lengths are cut off the tubular sheet and the bottom seams are inserted into the open-mouth bags 2. Or else, pre-fabricated or pre-formed open-mouth bags 2 may be used.

During rotation, which in this instance is counter-clockwise, the open-mouth bags 2 are filled. In other system configurations a clockwise rotation is possible. Simultaneously the compactors 19 in the shape of vibrating devices or shaking devices which are provided at each filling unit 3 and which are height-adjustable, attain compacting of the product so that the product level is reduced. Due to the product being compacted the open-mouth bags 2 required are on the whole shorter and a tightly filled open-mouth bag 2 is formed that does not only use less sheet material but also offers an optically attractive appearance.

The sheet used for forming the open-mouth bags 2—unlike paper bags—results in a relatively low inherent stiffness of the open-mouth bags 2. This ensures precisely defined guiding of the open-mouth bags 2 at all times to enable comparatively short bag lengths and short bag material overhang as well as reliable operation.

When the open-mouth bag 2 is filled with the intended quantity and reaches the angular position of the discharge device 40 then the open-mouth bag 2 is discharged from the filling spout 4. Discharge of the open-mouth bag 2 from the filling spout takes place during the continuous rotation of the packaging machine 1. The discharged bag 2 is transferred by the discharge device 40, which is likewise rotary, to the processing device 41 which comprises a linear guide 21 and one or more closing device(s) 20. The at least one closing device 20 closes the open top or mouth of the open-mouth bag 2. In discharge it is again ensured that holding and guiding the open-mouth bag 2 is precisely defined at all times so that a defined closing of the open-mouth bags 2 can be ensured.

A protective fence 33 may be provided to prevent access to the danger zone.

The rotary packaging machine 1 is preferably suspended from framework 30 with poles 31 supporting the rotary packaging machine. In the upper range of the rotary portion a silo 32 may be provided for intermediate product storage.

Appending the open-mouth bags 2 will now be described in detail.

FIG. 3 shows a simplistic perspective view of the transfer device 6 and part of the packaging machine 1. For the sake of clarity not all the components are illustrated.

The packaging machine 1 rotates counterclockwise in the direction of rotation 28. The packaging machine 1 is provided with the filling units 3 each comprising a filling spout 4 and vertically beneath, a compactor 19. The compactor 19 serves for compacting and lowering the product level during or after the filling process and it supports the bottom of the open-mouth bag intended for filling during the filling process.

For placement of an open-mouth bag 2 intended for filling, an open-mouth bag 2 received e.g. at the gripping unit 10 of the gripping arm 8 is appended by the transfer device 6 to a filling spout 4 of the packaging machine 1.

To this end the gripping arm 8 performs a longitudinal motion approximately in the peripheral direction. The gripping unit 10 of the gripping arm 8 is moved approximately in synchrony with the filling spout 4. While the filling spout 4 is overlapping with the top bag opening 35 the gripping arm 8 is vertically pivoted about the pivot axis 36 far enough upwardly until the top bag opening 35 has traveled from the position shown in FIG. 3 beneath the filling spout to the placing position shown in FIG. 4 in which the open-mouth bag 2 is appended at the filling spout 4.

After the open-mouth bag 2 has been fixed in a defined position at the filling spout 4 by grippers, not shown in detail, of the filling unit 3, the grippers and/or suckers 12 of the gripping unit 10 detach. As the packaging machine 1 continues rotating the open-mouth bag 2 appended to the filling spout 4 rotates out of the U-shaped gripping unit 10 of the gripping arm 8 and is filled during the further rotation of the packaging machine 1.

The gripping arm 8 is moved back linearly together with the gripping arm 9 to once again take the approximate position shown in FIG. 3. Simultaneously the gripping arm 8 is pivoted back vertically downwardly.

The function of placement of the open-mouth bags intended for filling will be discussed in detail below with reference to the FIGS. 5 through 12 which illustrate in schematic top views sequential stages of motion of the packaging machine 1.

FIG. 5 shows a first position in which the transfer device 6 with the gripping arm 8 and the gripping unit 10 provided thereat is in a holding position, waiting for a filling unit 3 with a filling spout 4 to arrive. The packaging machine 1 presently rotates counterclockwise in the illustrated direction of rotation 28.

As the filling spout 4 has arrived substantially immediately above the bag opening 35 of the bag 2, the gripping arm 8 accelerates in the longitudinal direction 37 and moves in synchrony with the filling spout 4 so as to result in an overlapping as long as possible of the bag opening 35 with the filling spout 4. Within the overlapping phase the open-mouth bag 2 is placed onto the filling spout 4 of the filling unit 3 from beneath.

FIG. 7 shows a state in which the gripping arm 8 of the transfer device 6 has traveled a distance 22 at the linear guide 17. In this position the filling spout is exactly above the bag opening 35. The bag opening 35 is exactly held in position at the gripping unit 10 by various grippers and/or suckers 12. Grippers are likewise provided for holding the gusseted sections of the bag wall 18.

The gripping arm 9 on the side opposite the transfer device 6 holds an already opened open-mouth bag 2 by means of the gripping unit 11. The gripping arm 9 is moved jointly with the gripping arm 8. The gripping arms 8 and 9 are structured symmetrically relative to the rotation axis 34.

FIG. 8 shows the state as the gripping arm 8 has traveled the distance 23. In this situation the bag opening 35 and the filling spout 4 only just overlap. In this situation the open-mouth bag 2 has already been appended to the filling spout 4 and the grippers provided at the filling unit 3 have gripped the bag wall 18 of the open-mouth bag 2 intended for filling. As the open-mouth bag 2 is securely held by the grippers of the filling unit 3, the grippers 12 of the gripping unit 10 of the gripping arm 8 can release the open-mouth bag 2.

FIG. 9 shows the state where the open-mouth bag 2 appended to the filling spout 4 has rotated out of the U-shaped gripping unit 10. The U-shaped gripping unit 10 is designed open in the direction of rotation of the packaging machine 1 so that the open-mouth bag 2 can be moved out of the U-shaped gripping unit 10. Thereafter the gripper arms 8 and 9 of the transfer device 6 return to the home position along the linear guide 17 as it is illustrated for example in FIG. 9.

FIG. 10 shows the rotary motion of the transfer device 6 by means of which the gripping arm 9 rotates to the appending position while the gripping arm 8 moves to the take-up position in which the gripping arm 8 with the gripping unit 10 provided thereat receives another open-mouth bag 2 from the bag feeding unit 14. Simultaneously with the rotary motion of the gripping arms 8 and 9 the bag feeding unit 14 travels for transferring to the gripping arm 8 the next open-mouth bag 2 intended for appending.

The open-mouth bag 2 at the gripping arm 9 is rotated into the appending position with the upper bag opening 35 made in the open-mouth bag 2.

FIG. 12 shows the state shortly before the gripping arm 9 reaches the holding position where the gripping arm 9 is waiting for the next filling spout 4 of a filling unit.

At the same time the bag feeding unit 14 hands over an open-mouth bag 2 to a bag opener 13 which makes the bag opening 35 in the upper bag wall. The contour of the bag opening 35 is adapted to the outer contour of the filling spout 4 which is presently a hexagon. This shape has been found to be optimal.

Or else it is possible to provide a bag opener 13 each at a gripping arm 8 and at the gripping arm 9 so that the bag 2 is being opened during the rotary motion of the gripping arms 8 and 9 about the rotation axis 34.

The bag opener 13 comprises suckers gripping the upper bag walls and pulling them apart as defined so that the shape of the bag opening 35 is obtained.

When the bag feeding unit 14 has handed over a bag, the bag feeding unit 14 is axially returned to the distance 38 to receive the already waiting, next open-mouth bag 2.

On the whole the invention allows the structure of a very advantageous, continuously rotating packaging machine 1 for filling open-mouth bags. High filling rates can be achieved. It is possible to fill 1500 bags per hour and even 2000 per hour and even more than 2500 bags per hour by means of such a packaging machine 1 according to the invention even when bagging fine and superfine bulk goods. At the same time the bag guiding is defined at all times, so that the bag length required is short and optically attractive open-mouth bags are filled.

Moreover a still more secure and more reliable operation is enabled.

List of reference numerals:

| | |
|---|---|
| 1 | Rotary packaging machine |
| 2 | open-mouth bag |
| 3 | filling unit |
| 4 | filling spout |
| 5 | filling opening |
| 6 | transfer device |
| 8 | gripping arm |
| 9 | gripping arm |
| 10 | gripping unit |
| 11 | gripping unit |
| 12 | gripper, sucker |
| 13 | bag opener |
| 14 | bag feeding unit |
| 15 | gripper |
| 16 | gripper |
| 17 | linear guide |
| 18 | bag wall |
| 19 | compactor |
| 20 | closing device |
| 21 | linear guide |
| 22 | distance |
| 23 | distance |
| 26 | bag former |
| 28 | direction of rotation |
| 29 | feed hopper |
| 30 | framework |
| 31 | pole |
| 32 | silo |
| 33 | protective fence |
| 34 | rotation axis |
| 35 | bag opening |
| 36 | pivot axis |
| 37 | longitudinal direction |
| 38 | distance |
| 39 | direction of rotation |
| 40 | discharge device |
| 41 | processing device |

The invention claimed is:

1. Rotary packaging machine (1) for filling open-mouth bags (2) having multiple filling units (3) disposed over the circumference and rotating along each of which having a filling spout (4) with a filling opening (5) at the bottom, wherein by way of a motion oriented upwardly relative to the filling spout the open-mouth bags (2) can be appended, characterized in that a transfer device (6) is provided for transferring the open-mouth bags (2) intended for filling to the filling units (3) which comprises at least one gripping arm (8, 9) including a gripping unit (10, 11) provided thereat, wherein the gripping arm (8, 9) is rotatingly disposed at the transfer device (6) and wherein a longitudinal speed of the longitudinal motion of the gripping arm (8, 9) is at least temporarily adapted to a peripheral speed of the peripheral motion of the filling spouts (4), and wherein at least one bag opener (13) is provided, said bag opener (13) being configured at the transfer device (6) to rotate along.

2. The rotary packaging machine (1) according to claim 1 wherein the gripping arm (8, 9) is disposed at the transfer device (6) to be longitudinally movable for carrying out a longitudinal motion relative to the transfer device (6).

3. The rotary packaging machine (1) according to claim 2 wherein the gripping arm (8, 9) is disposed at the transfer device (6) so as to be movable linearly and/or arcuate at least in portions.

4. The rotary packaging machine (1) according to claim 1 wherein the rotation of the gripping arm at the transfer device (6) is indexed.

5. The rotary packaging machine (1) according to claim 1 wherein at least part of the transfer device (6) is movable in height.

6. The rotary packaging machine (1) according to claim 5, wherein the gripping unit (10, 11) is height-adjustable by way of the gripping arm (8, 9) pivoting in height.

7. The rotary packaging machine (1) according to claim 6, wherein the filling spout is height-adjustable for appending.

8. The rotary packaging machine (1) according to claim 1 wherein the bag opener (13) transfers the opened open-mouth bag (2) to the transfer device (6).

9. The rotary packaging machine (1) according to claim 1 wherein the filling unit (3) comprises at least one compactor (19).

10. The rotary packaging machine (1) according to claim 1 wherein at least one bag former (26) is provided.

11. Method for filling open-mouth bags (2) by means of a rotary packaging machine (1) comprising multiple filling units (3) disposed over the circumference and rotating along wherein during rotation the open-mouth bags (2) are appended to the bottom filling opening (5) of the filling spouts (4) by way of a motion oriented upwardly relative to the filling spout (4), characterized in that a transfer device (6) is provided comprising a rotating gripping arm (8, 9) including a gripping unit (10, 11) and that a longitudinal speed of the longitudinal motion of the gripping arm (8, 9) is at least temporarily adapted to a peripheral speed of the peripheral motion of the filling spouts (4) and that the transfer device (6) with the gripping unit (10, 11) transfers the open-mouth bags (2) during rotation to the filling unit (3).

12. The method according to claim 11 wherein the gripping unit (10, 11) is moved linearly at least in part to enable an extended handover phase.

13. The method according to claim 11 wherein the gripping unit (10, 11) is moved arcuate at least in part to enable an extended handover phase.

14. The method according to claim 11 wherein an open-mouth bag (2) is appended to the filling spout (4) from beneath by way of a pivoting motion of the gripping arm (8, 9).

15. Rotary packaging machine (1) for filling open-mouth bags (2) having multiple filling units (3) disposed over the circumference and rotating along each of which having a filling spout (4) with a filling opening (5) at the bottom, wherein by way of a motion oriented upwardly relative to the filling spout the open-mouth bags (2) can be appended, characterized in that a transfer device (6) is provided for transferring the open-mouth bags (2) intended for filling to the filling units (3) which comprises at least one gripping arm (8, 9) including a gripping unit (10, 11) provided thereat, wherein the gripping arm (8, 9) is rotatingly disposed at the transfer device (6) and wherein a longitudinal speed of the longitudinal motion of the gripping arm (8, 9) is at least temporarily adapted to a peripheral speed of the peripheral motion of the filling spouts (4), and wherein at least one bag opener (13) is provided, said bag opener (13) transferring the opened open-mouth bag (2) to the transfer device (6).

* * * * *